US007743927B2

(12) United States Patent
Svatek et al.

(10) Patent No.: US 7,743,927 B2
(45) Date of Patent: Jun. 29, 2010

(54) ADJUSTABLE SLIDE WIDTH REDUCER FOR GRAVITY SLIDE SORTER

(75) Inventors: Dale Adolph Svatek, Needville, TX (US); Patric Carey Pike, Hopkins, MI (US)

(73) Assignee: Satake USA, Inc., Stafford, TX (US)

( * ) Notice: Subject to any disclaimer, the term of this patent is extended or adjusted under 35 U.S.C. 154(b) by 310 days.

(21) Appl. No.: 12/030,293

(22) Filed: Feb. 13, 2008

(65) Prior Publication Data

US 2009/0200214 A1 Aug. 13, 2009

(51) Int. Cl.
*B07C 5/00* (2006.01)

(52) U.S. Cl. ..... 209/656; 209/655; 209/657; 209/658; 209/908; 209/911; 193/25 FT; 193/46

(58) Field of Classification Search ..... 209/655, 209/656, 657, 658, 908, 911; 193/14, 23, 193/25 A, 25 FT, 33, 2 D, 46
See application file for complete search history.

(56) References Cited

U.S. PATENT DOCUMENTS 4,042,100 A * 8/1977 Morrone ..... 198/446
4,934,537 A * 6/1990 DeBourke ..... 209/588
5,090,574 A * 2/1992 Hamby ..... 209/552
5,277,300 A * 1/1994 Maggioni ..... 198/759
5,469,973 A * 11/1995 Booth et al. ..... 209/580
5,489,019 A * 2/1996 DiNanno et al. ..... 198/752.1
5,831,856 A * 11/1998 Lin ..... 700/121
5,845,784 A 12/1998 Gray et al.
5,986,230 A * 11/1999 Novak et al. ..... 209/579
6,814,210 B1 * 11/2004 Hendzel ..... 193/8
6,814,211 B2 11/2004 Yunker
7,503,449 B2 * 3/2009 Suter et al. ..... 198/771

* cited by examiner

*Primary Examiner*—Douglas A Hess
(74) *Attorney, Agent, or Firm*—James E. Hudson, III; Crain, Caton & James, P.C.

(57) ABSTRACT

An apparatus, and method of use, for reducing the operable width of the inclined slide of a gravity fed sorting machine includes an upper section for reducing the flow rate into the slide and for directing the reduced flow to the operable portion of the slide and a lower section for delimiting the operable portion of the slide. The upper section includes a body proximate the gravity fed sorting machine and which is connected to a product flow rate adjustment assembly and a partition so the product flow into the slide may be controlled and the flow of materials directed to the operable portion of the lower section, which includes a slide width control guide to limit the operable width of the inclined slide.

15 Claims, 10 Drawing Sheets

ADJUSTABLE SLIDE WIDTH REDUCER FOR GRAVITY SLIDE SORTER

CROSS REFERENCE TO RELATED APPLICATIONS

None.

STATEMENT REGARDING FEDERALLY SPONSORED RESEARCH OR DEVELOPMENT

Not Applicable.

BACKGROUND OF THE INVENTION

1. Field of the Invention

This invention pertains to a system for adjustably reducing the effective width of a slide for a gravity-fed machine intended for sorting a high volume of product.

2. Description of the Related Art

A typical sorting machine of the type using the present invention may generally be characterized as a gravity-fed sorter. A gravity-fed sorter incorporates at least one slide or chute positioned at a steep angle that may have one or more channels across the width of each slide. A hopper or other feed system is positioned to dispense product to the top of the slide or slides. Typically a near-horizontal surface, a tray, exists between the hopper, or feed system, and each slide. Some system, such as a vibratory feeder, may be associated with this tray to encourage product to flow from the hopper to the slide. If sorting with multiple channels is desired, the slide is divided across its width into channels to provide a uniform number of dispensed products to each channel. Techniques for distributing the proper amount of product to each channel of the slide are well-known in the art. When divided a slide may have any number of channels, limited only by the width of the slide and the channel width necessary to permit the desired product to pass.

In operation, each slide of these sorters presents a single-layer stream of product approaching distribution across the full width of the slide to the sorting machine's viewer system, which may view one or opposite sides of the passing product. The viewer system images the entire width of the passing product stream at a location referred to as the scan line to permit identification of the horizontal position of a particular product to be removed from the passing flow. Located below the viewer system is an ejector system that may include one or more rows of ejectors permitting removal of the selected product from the passing flow. As is known in the art, activation of the individual ejector or group of ejectors associated with the last known horizontal position of the product to be removed is delayed for a time period equal to that necessary for the product to be removed to pass from the scan line to the ejector. The individual ejector or group of ejectors activated thereby deflects the selected product from the stream of product. As can be appreciated for the effectiveness of the viewer, it is critical for each product to pass through the scan line and to do so visible to all viewers employed. Likewise as can be appreciated for the effectiveness of the ejector system, it is critical that each product to not to move laterally between the viewer and ejector system. Finally, it is also critical for the effectiveness of both components that each product follow a common trajectory.

Thus it is the purpose of the slide to accelerate and singulate the product flow so that each product has the same downward velocity and no lateral velocity, i.e. the same trajectory, and to present the product uniformly to the scan line. One manner of encouraging singulation is to pass product down the slide in sufficient volume to fill the slide to at least a minimum density. However, if product is supplied at less than the operating capacity of the single channel slide, then singulation may not be reached and product may travel laterally between the scan line and ejector system. Additionally, when product is not laterally constrained, either by full chute capacity or by channels, a smooth chute will not achieve singulation due to the lateral movement of the product. Thus a further manner of encouraging singulation is by locating multiple channels across the surface of the slide so that once product enters a channel, its lateral travel is reduced or eliminated. However, even if singulation is reached, a channeled chute will not operate at its highest efficiency if the slide is not run at capacity as substantial gaps will occur among products passing or in a flow to pass the scan line.

Often a flow rate is desired that is lower than that provided by the original slide. A lower flow rate may be desired for machine testing or for sorting of a volume of product below the flow rate optimal for the slide in the sorting machine, particularly in connection with small product volumes such as testing or new seed development. Logically, singulation may be achieved for such lower flow rates by reducing the width of the slide, thus increasing the density of the product. In the prior art, reducing the slide width has required removal of the original slide and installation of a slide having a width sized to or near to the desired flow rate. Thus changing slides has required the physical disassembly of the sorting machine. Moreover, as the width of the slide controls the flow rate, operators have been able to select from a limited number of flow rates absent a wide variety of slides.

By eliminating the need for disassembly and reassembly, and the time associated with the reconfiguration, the sorting machine may be made more productive. Likewise, by providing a greater number of potential flow rates, the sorting machine may be made more productive. However, merely changing the slide width would create further difficulties. The product is supplied to the tray at a flow rate consistent with the slide supplied with the sorting machine. Thus the flow rate of product to the tray must also be reduced to avoid overfilling the slide. Moreover, as the tray is sized with a width equal to the slide, the effective width of the tray must be reduced to avoid loss of product beyond the slide width or the need to recycle unprocessed product.

Thus there exists a need for a process and apparatus for rapidly reconfiguring the slide of a gravity slide sorter to various widths, for ensuring product is supplied only to the operable width of the slide sorter, and for reducing the flow rate from the product supply to the maximum capacity of the reduced slide width.

SUMMARY OF THE INVENTION

Accordingly, it is an object of the present invention to provide a process and apparatus for rapidly reconfiguring the slide of a gravity slide sorter to various widths, for ensuring product is supplied only to the operable width of the slide sorter, and for reducing the flow rate from the product supply to the maximum capacity of the reduced slide width.

The adjustable slide width reducer disclosed herein includes an upper section for reducing the flow rate into the slide and for directing the reduced flow to the operable portion of the slide and a lower section for delimiting the operable portion of the slide. The upper section includes a body positioned proximate or affixed to the gravity fed sorting machine and which is connected to a partition which constrains the flow of product, and to a product flow rate adjustment assembly having an aperture to limit the flow rate of product. The lower section includes at least one slide width control guide to limit the operable width of the inclined slide. The slide width control guide may be removably affixed to the slide or may be affixed to an associated mounting bracket affixed to the slide.

The flow rate of product to be sorted may thus be controlled by adjusting the cross sectional area of the aperture of the product flow rate assembly, positioned between a product supply and the inclined slide. The product to be sorted then feeds to the operable portion of the inclined slide, constrained by a partition narrowing the passageway at the top of the inclined slide.

After installation, the adjustable slide width reducer may be used by positioning the body next to or proximate the gravity slide sorter, positioning the aperture to control the flow rate of the product through the gravity slide sorter, positioning the partition relative to the tray to provide a desired passageway, the partition having a lower edge adjacent the tray and extending at least to the outflow edge of the tray, maintaining the position of the partition, positioning a slide width control guide, the slide width control guide aligned with said partition, where the slide width control guide is parallel to the inclined slide, and maintaining the position of said slide width control guide.

The present invention provides a variety of slide widths while eliminating the need for disassembly and reassembly to obtain such slide widths, reduces the time associated with the reconfiguration, provides a variety of slide widths, and thus renders the sorting machine more productive.

The foregoing and other objectives, features, and advantages of the invention will be more readily understood upon consideration of the following detailed description of the invention, taken in conjunction with the accompanying drawings.

BRIEF DESCRIPTION OF THE DRAWINGS

So that the manner in which the described features, advantages and objects of the invention, as well as others which will become apparent, are attained and can be understood in detail, more particular description of the invention briefly summarized above may be had by reference to the embodiments thereof that are illustrated in the drawings, which drawings form a part of this specification. It is to be noted, however, that the appended drawings illustrate only typical preferred embodiments of the invention and are therefore not to be considered limiting of its scope as the invention may admit to other equally effective embodiments.

In the drawings.

DETAILED DESCRIPTION OF THE PREFERRED EMBODIMENT

Figure 2:
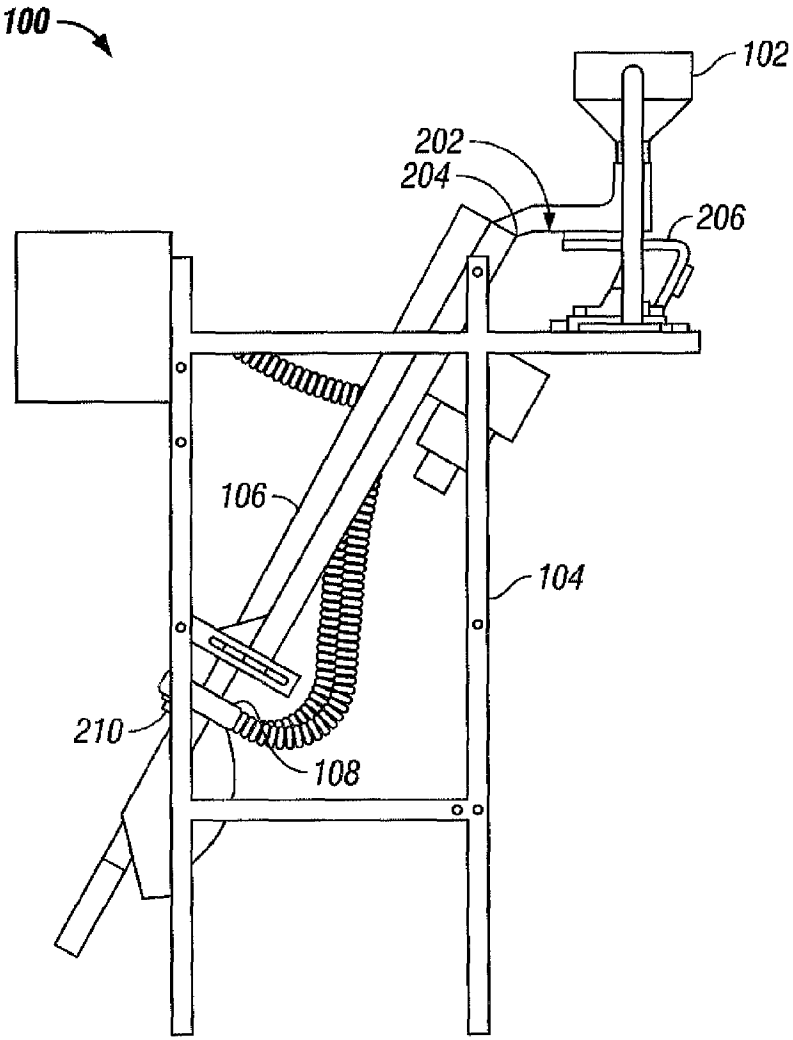
FIG. 2 (Prior Art)
FIG. 2 illustrates a side view of a conventional gravity fed sorting machine having two slides.
Figure 1:
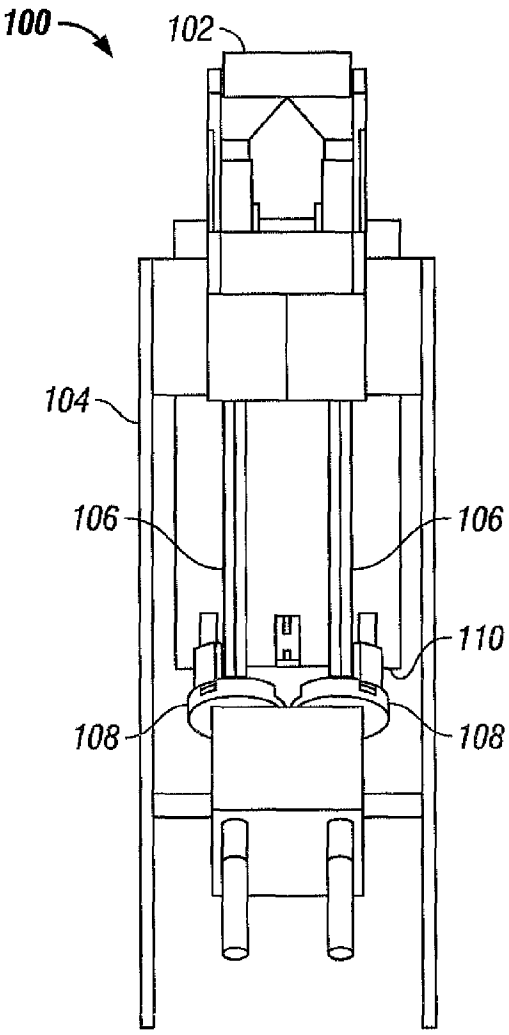
FIG. 1 (Prior Art)
FIG. 1 illustrates a front view of conventional gravity fed sorting machine having two slides.

Now referring to the drawings, and first to FIG. 1 and FIG. 2, a high-speed gravity-fed sorter 100 with two slides 106 known in the art for separating fungible products or items from a passing single-layer flow of such products is illustrated. Each slide 106 is maintained by the gravity-fed sorter 100 at a steep angle to the horizontal, usually on the order of 60 degrees, by a framework 104. The gravity-fed products to be sorted are fed from a product supply 102 so that the product is induced from the opening associated with a product supply 102 to a slide 106 on a surface 202, typically a tray, by a vibratory feeder 206 or a continuous belt (not shown). The products to be separated or sorted are typically small fungible items, such as coffee beans, rice grains, plastic shards, or the like. Such products are readily individually identifiable and distinguishable by color or shade of color in one or more spectral bands by the optical vision system 108 employed by the sorter 100. Gravity action draws the feed down the respective slide 106. The flow of the products is less than from free fall largely due to the friction and normal (perpendicular) force from the surface 322 (illustrated in FIG. 3) of the slide 106, and the interaction forces among descending products. The products do move, however, at a fast rate and in large quantity, as is well known in the art.

Referring to FIG. 1 and FIG. 2, an optical vision system 108 is located adjacent the lower end 110 of the slide 106. As is well known in the art, the optical vision system 108 includes at least one optical viewer (not shown) which views each product from one side as it passes a horizontal imaging line, known as the scan line. As products pass the scan line, nonstandard or substandard products, as well as foreign objects, are sensed or detected. When a nonstandard product or a foreign object is sensed, an electrical signal is produced that results in an ejection of such product or object by an ejector 210 located in close proximity to the product stream and located at a predetermined distance beneath the optical vision system 108. Typically, the ejector 210 is a pneumatically operated nozzle that produces an air jet and is activated after a predetermined delay time once the item to be removed has been detected in the corresponding viewing station. That is, an actuating electrical signal is produced as a result of the optical vision system 108 that, in turn, causes the expulsion or removal of the nonstandard item from the product stream.

Again referring to FIG. 1 and FIG. 2, the typical gravity slide sorter 100 is associated with a supply 102 of product to be sorted, which is typically a hopper, but may be a larger accumulator, such as a storage bin, or a valve-controlled hose connected to a large product supply. The gravity slide sorter 100 includes a surface 202 intermediate the product supply 102 and the one or more inclined slides 106. As can be appreciated, the product supply 102 is divided before or within the gravity slide sorter 100 to deliver product to each inclined slide 106 of the gravity slide sorter 100 (not shown). The surface 202 may be a metallic surface associated with a vibratory feeder 206 so that product is induced to move, and by the force of further product from the product supply 102, to move from the product supply 102 to the inclined slide 106. Other systems for moving the product from the product supply 102 to the inclined slide 106 are well known in the art, such as a continuous belt. The product ultimately passes from an outflow edge 204 of the surface 202, located above the slide 106, to the slide 106.

Figure 3:
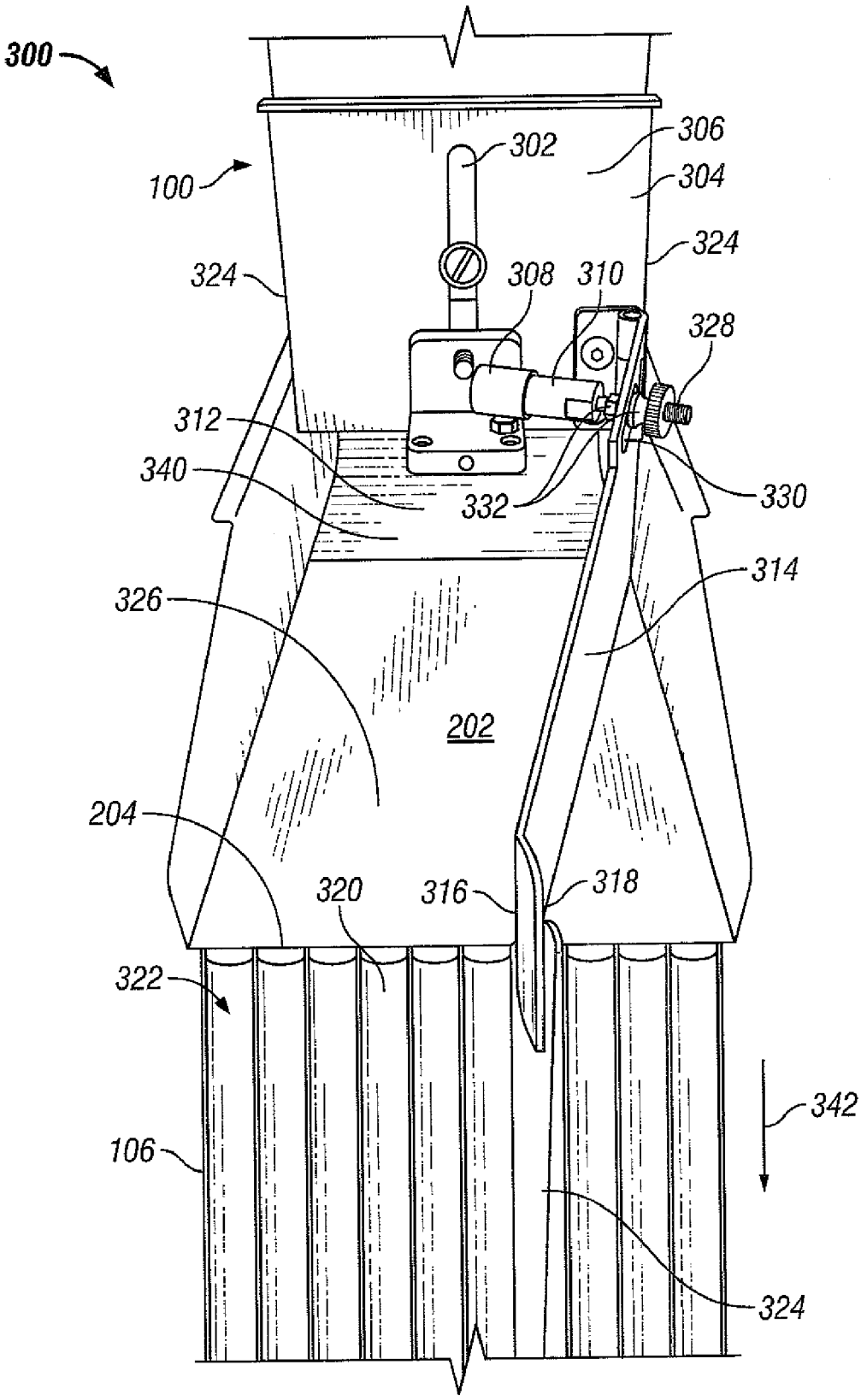
FIG. 3 illustrates a front view of the reduction portion of the present invention with a single partition and adjustment arm assembly, together with one preferred slide width control guide.

Referring to FIG. 3, the adjustable slide width reducer 300 (shown with a multiple channel slide 106) includes a body 306, product flow rate adjustment assembly 304, a partition 314, and a slide width control guide 324. As illustrated in FIG. 3, a body 306 is removably attached to a gravity slide sorter 100 adjacent the flowpath 312 associated with a product supply 102. In the preferred embodiment a body 306 is affixed to a gravity slide sorter 100 immediately above the flowpath 312 associated with the product supply 102. The product flow rate adjustment assembly 304 may feature a slotted mounting location 302. Alternatively, the product flow rate adjustment assembly 304 may include a plurality of mounting locations. The body 306 may therefore be positioned upward or downward to decrease aperture 340 and thus increase or restrict the flow rate of product flowing from a product supply 102 through a flowpath 312 to a surface 202, also known as the tray. The body 306 spans the full width of the surface 202, or may include horizontal adjustment plates (not shown) to permit horizontal expansion or contraction of the body 306 and therefore use of an adjustable slide width reducer 300 over a variety of widths of the surface 202.

A partition 314 is attached to a body 306 at its outermost horizontal edges 324 so that the lower edge 316 of the partition 314 is adjacent the surface 202. In the preferred embodiment reducer the partition 314 is hingedly attached. However the partition 314 may be attached to adjust laterally to reduce the flowpath 312. In both instances, no product may pass between the lower edge 316 of the partition 314 and the surface 202. The partition 314 extends at least to the outflow edge 204 of the surface 202, terminating at its end 318. A passageway 326 is formed near the end 318 of the partition 314 where the surface 202 communicates with the inclined slide 106, having a product direction of travel 342. As depicted in FIG. 3, slide 106 includes a plurality of channels 320. In cases where the partition 314 is hingedly attached to the body 306 at its outermost horizontal edges 324, the partition 314 may be positioned to reduce the passageway 326. Alternatively, where the partition 314 is permitted to laterally move to define the aperture 340, it will likewise narrow the passageway 326. In both cases, the flow rate from product supply 102 is reduced to avoid product overflow by reducing the effective cross-sectional area of aperture 340.

In the preferred embodiment, an adjustment arm 310, which is fixed relative to the body 306, maintains the partition 314, and therefore the passageway 326, in position against the flow of product. Preferably the adjustment arm 310 is pivotally fixed relative to the body 306. Ideally, the adjustment arm 310 is pivotally attached at its first end 308 to the body 306 and is connected proximate its second end 328 so that the position and angle of the partition 314 may be maintained by the adjustment arm 310. In the preferred embodiment, the adjustment arm 310 is pivotally attached to the body 306 at its first end 308 and is adjustable at its second end 328, which passes through a slotted section 330 of the partition 314. In the preferred embodiment, the second end 328 is threaded for adjustment and a set of nuts 332 are positioned near a threaded section of the adjustment arm second end 328 where it passes through the slotted section 330, thus maintaining the partition 314 in position.

Figure 4:
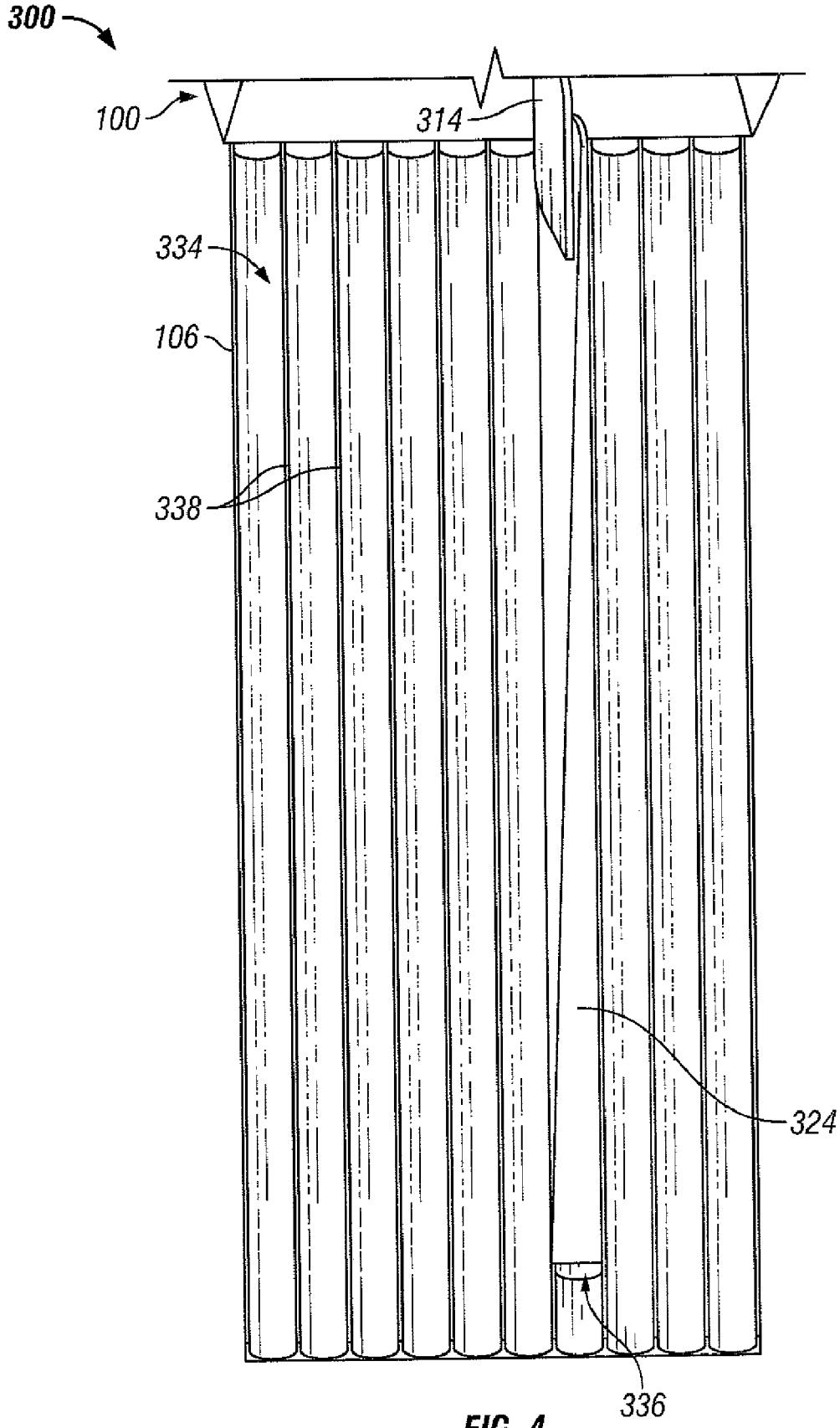
FIG. 4 illustrates a front view of the slide width control portion of the present invention with a preferred single slide width control guide.

Referring to FIG. 4, the lower section of the adjustable slide width reducer 300 delimits the operable portion of the slide 106 with a slide width control guide 324. The slide width control guide 324 removably contacts the inclined slide 106 to communicate with the partition 314 and extends downward from near the top of the inclined slide 106. As illustrated in FIG. 4, the slide 106 is divided into a plurality of channels by ribs 338. The slide width control guide 324 provides a lateral limit on the operable surface 334 of the inclined slide 106. Likewise, because the slide width control guide 324 is adjacent the surface 322 of the slide 106, product cannot pass between the bottom surface 336 of the slide width control guide 324 and the surface 322 of slide 106. Therefore, the slide width control guide 324 need extend downward from near the top of the inclined slide 106 only sufficiently far for the product to be retained in the channels.

By limiting the operable cross section of the inclined slide 106 to the operable surface 334 and by limiting the flow rate to one that produces singulation in the product to be imaged, a narrower inclined slide 106 is effectively provided without the need for disassembly and replacement of the installed slide 106. Moreover, as various flow rates may be necessary at different times, the partition 314 and the slide width control guide 324 may be repositioned to provide the slide width desired without disassembly of the sorting machine 100.

Figure 5:
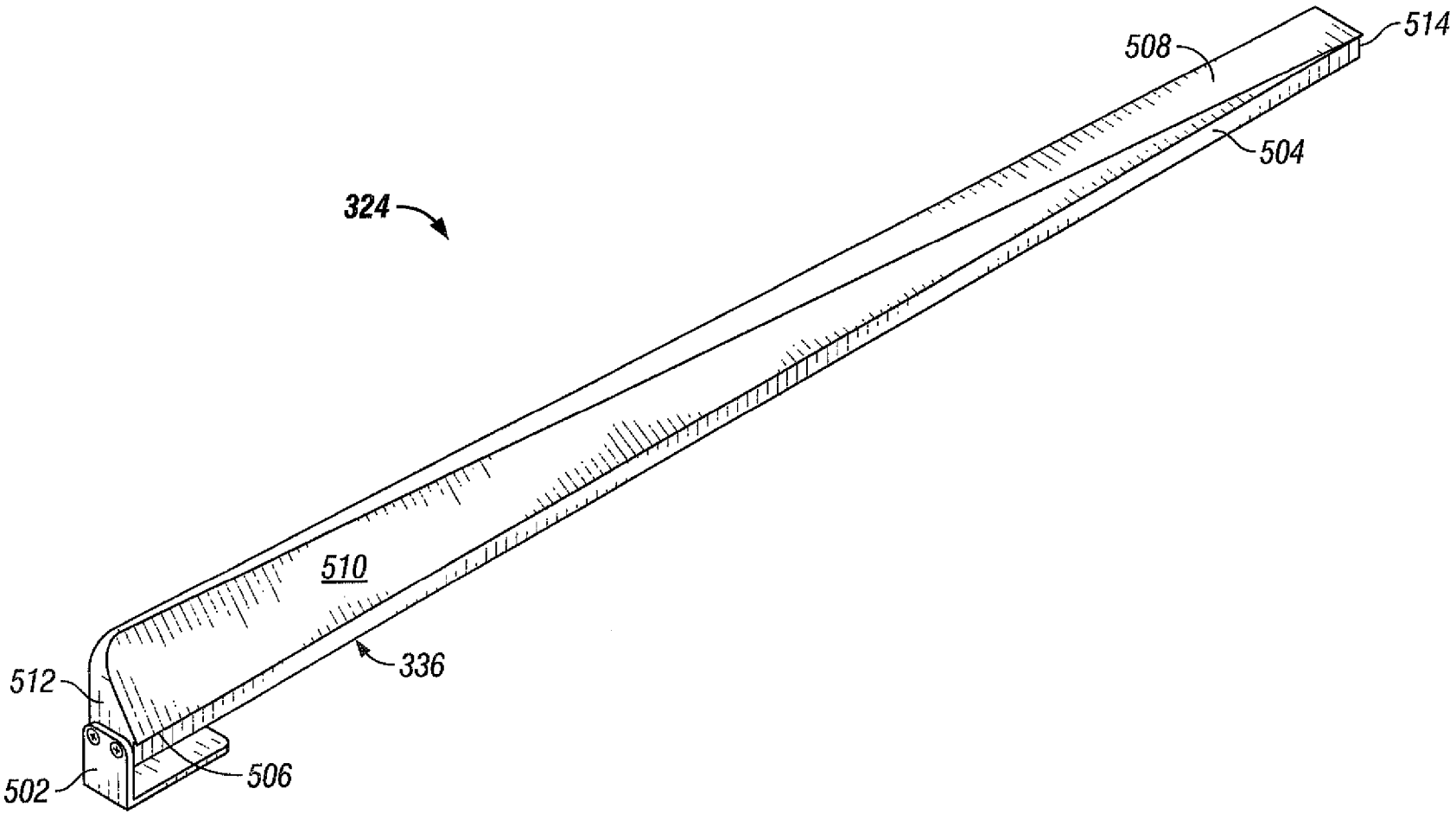
FIG. 5 illustrates an isometric view of the preferred single slide width control guide.
Figure 11:
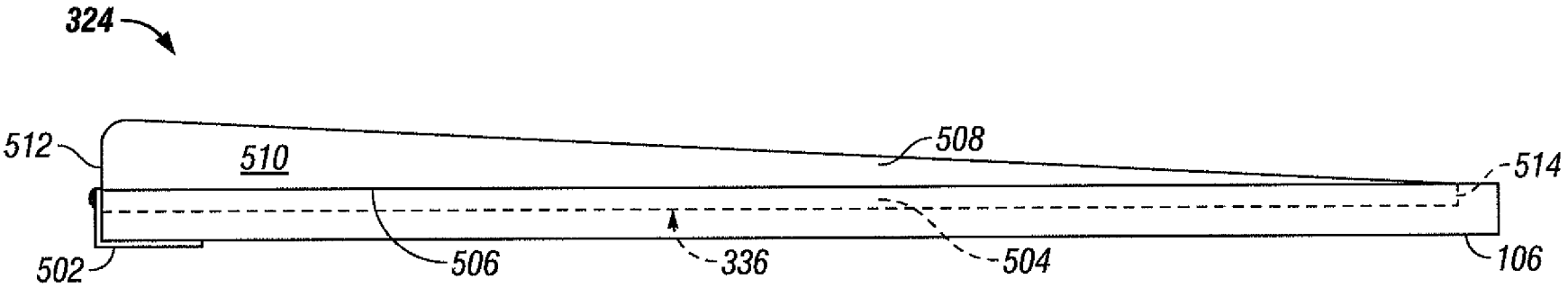
FIG. 11 illustrates the preferred single slide width control guide in contact with the slide of a sorting machine.

Referring to FIG. 5, a slide width control guide 324 may be fashioned to have a lower body 504 formed to fit within a channel 320 and between the ribs 338 which define each channel 320, a lip 506 to overlap rib 338, an upper body 508, and an impact and retention surface 510. Slide width control guide 324 has a top end 512, a lower end 514, and a bottom surface 336. A retention device 502, which may be a clip, is affixed to slide width control guide 324 proximate top end 512. Retention device 502 is sized to extend downward to contact the top edge of slide 106 and may contact the underside of slide 106 for greater stability, as illustrated in FIG. 11. Retention device 502 thereby maintains slide width control guide 324 in position against slide 106.

Figure 6:
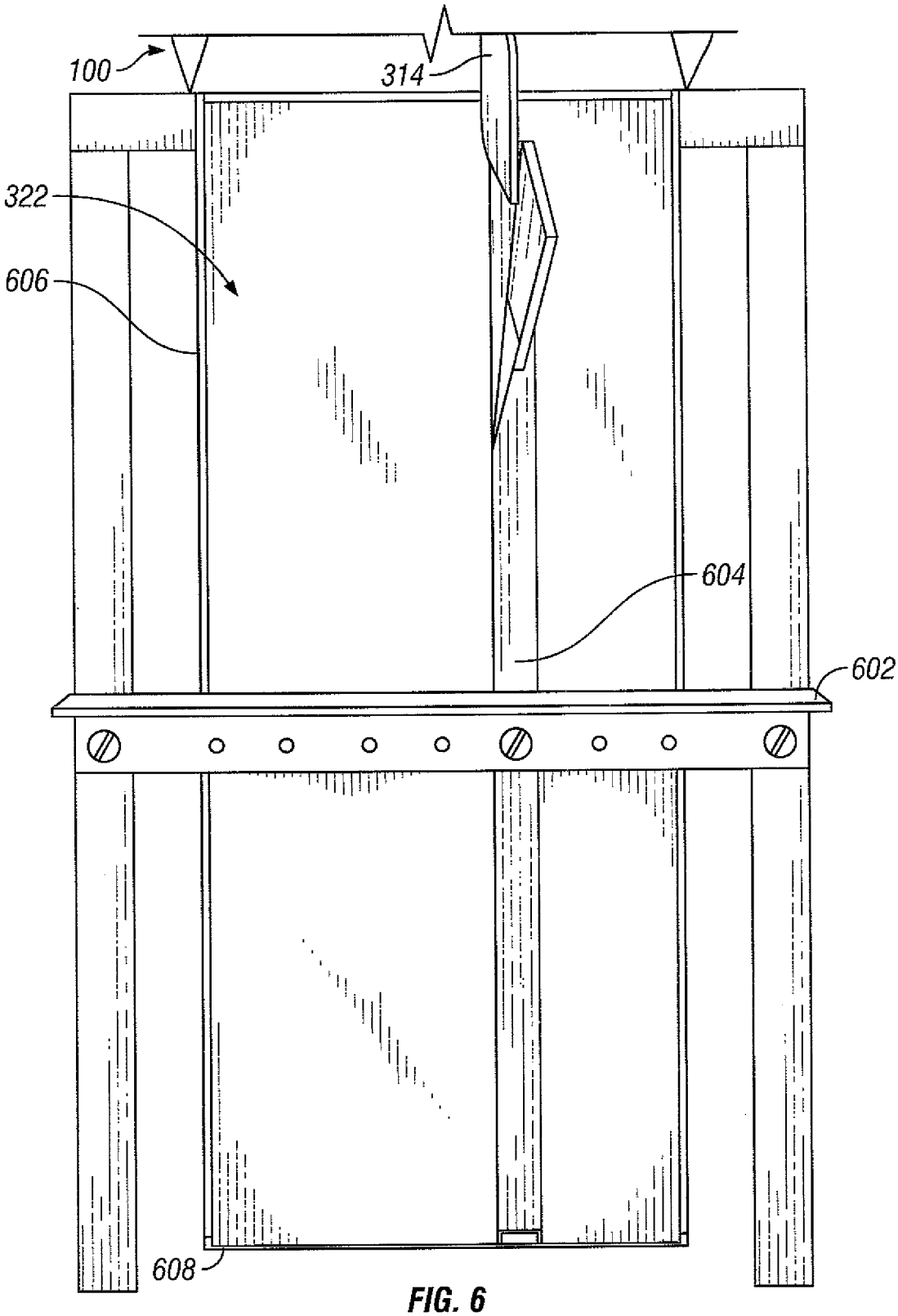
FIG. 6 illustrates a front view of the slide width control portion of the present invention with the alternative single slide width control guide assembly as used on a single channel slide.

Referring to FIG. 6, an alternative slide width control guide 604 is illustrated in connection with a single channel slide 606. The slide width control guide 604 is maintained in position and parallel to the inclined slide 606 by a slide width control guide mounting bracket 602, to which the slide width control guide 604 may be affixed. The slide width control guide 604 extends to the lower edge 608 of the inclined slide where a single channel slide 606 is used. Product exiting the inclined slide 606 and passing before the optical vision system 108, depicted in FIG. 1, is therefore confined to a fixed horizontal position. As provided previously, where the inclined slide 606 includes a plurality of channels, the alternative slide width control guide 604 is sized to fit between channels or over a channel 320 as depicted in FIG. 3

Regardless of the slide width control guide utilized, in operation, the adjustable slide width reducer 300 may be used by positioning the body 306 proximate the gravity slide sorter 100, positioning the aperture 340 to control the flow rate of the product through the gravity slide sorter 100, positioning the partition 314 relative to the surface 202 to provide a desired passageway 326, the partition 314 having a lower edge 316 adjacent the surface 202 and extending at least to the outflow edge 204 of the tray, maintaining the position of the partition 314, positioning a slide width control guide 324, the slide width control guide 324 aligned with said partition 314, where the slide width control guide 324 is parallel to the inclined slide and the slide direction of travel 342, and maintaining the position of said slide width control guide 324. As described above, the position of the slide width control guide 324 may be maintained via an attached slide width control clip 502, or, in the case of the alternative slide width control guide 604, by mounting bracket 602. Thereafter by selecting any passageway 326 and by repositioning the slide width control guide 324, any slide width may be selected. When not in use, the adjustable slide width reducer 300 may be removed or positioned at its maximum width.

Figure 7:
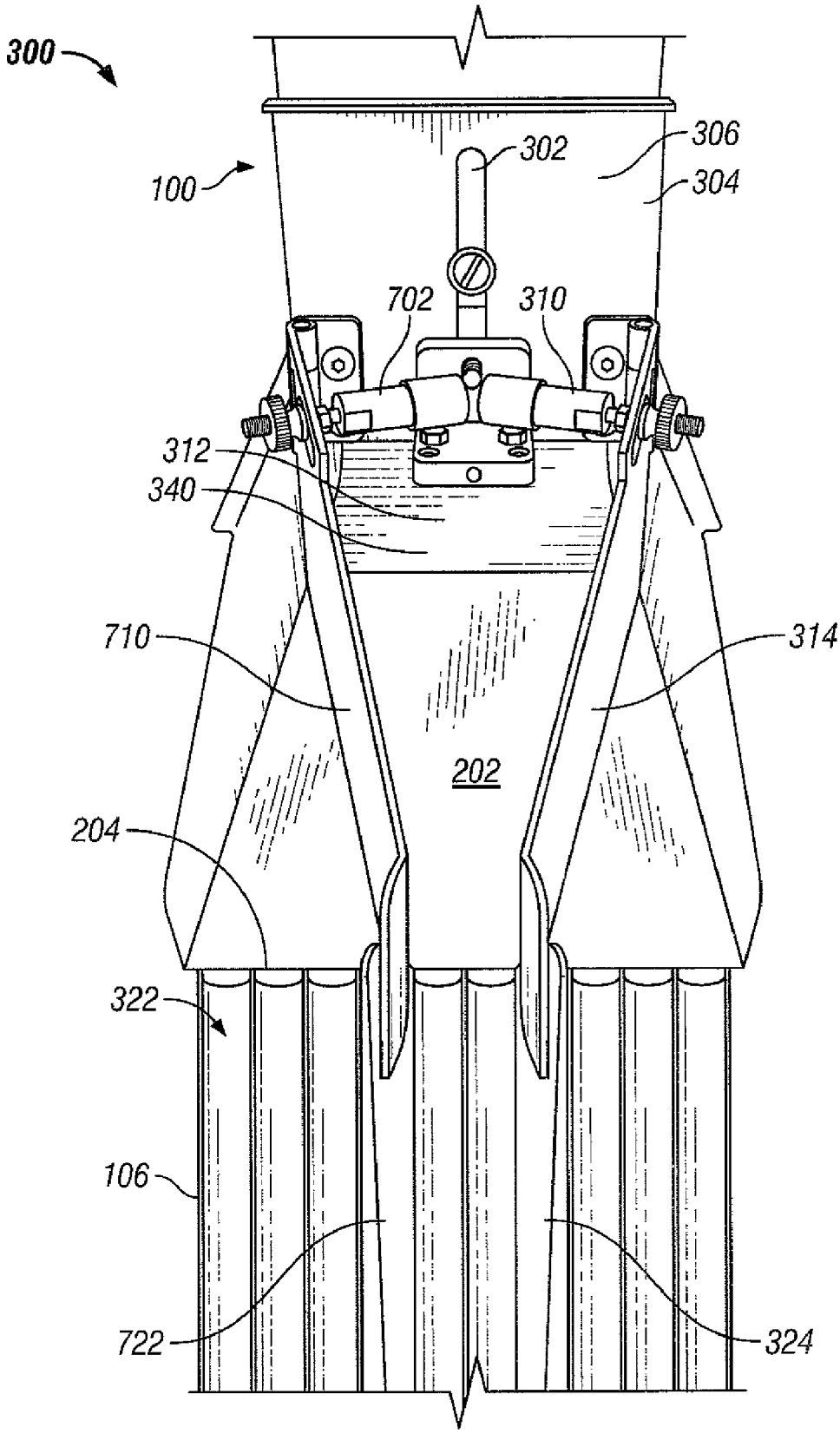
FIG. 7 illustrates a front view of the reduction portion of the present invention with two partitions and adjustment arm assemblies on a multiple channel slide.
Figure 8:
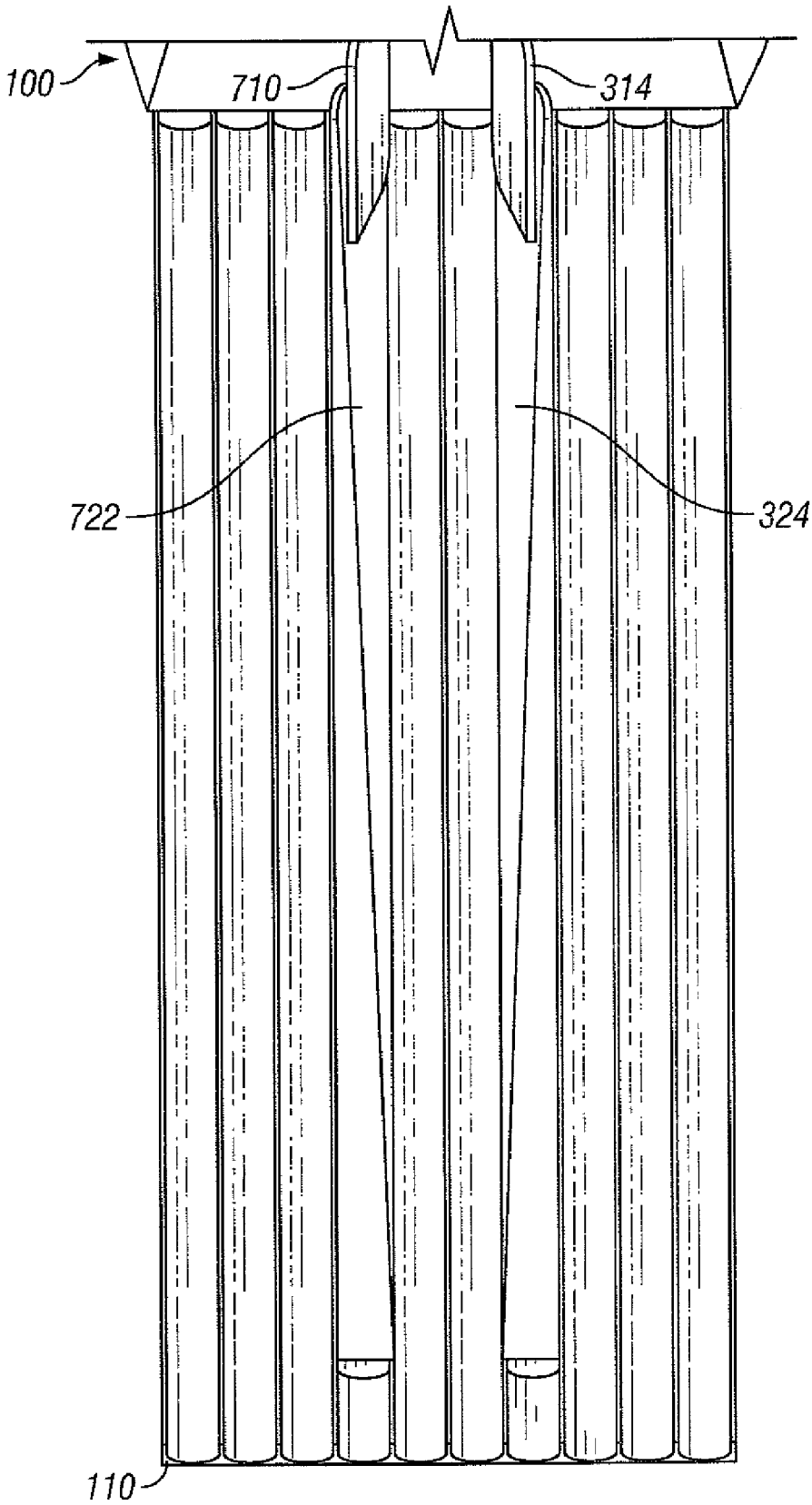
FIG. 8 illustrates a front view of the slide width control portion of the present invention with a dual slide width control guide assembly on a multiple channel slide.

Referring to FIG. 7 and FIG. 8, in a further alternative embodiment, pairs of adjustable arms 702 and 310, a pair of partitions 710 and 314, and a pair of slide width control guides 722 and 324 may be employed to center the product passing down the inclined slide 106. The second adjustment arm 702, the second partition 710, and the second slide width control guide 722 are mirror image of the adjustable arm 310, the partition 314, and the slide width control guide 324 illustrated in FIG. 3.

Figure 9:
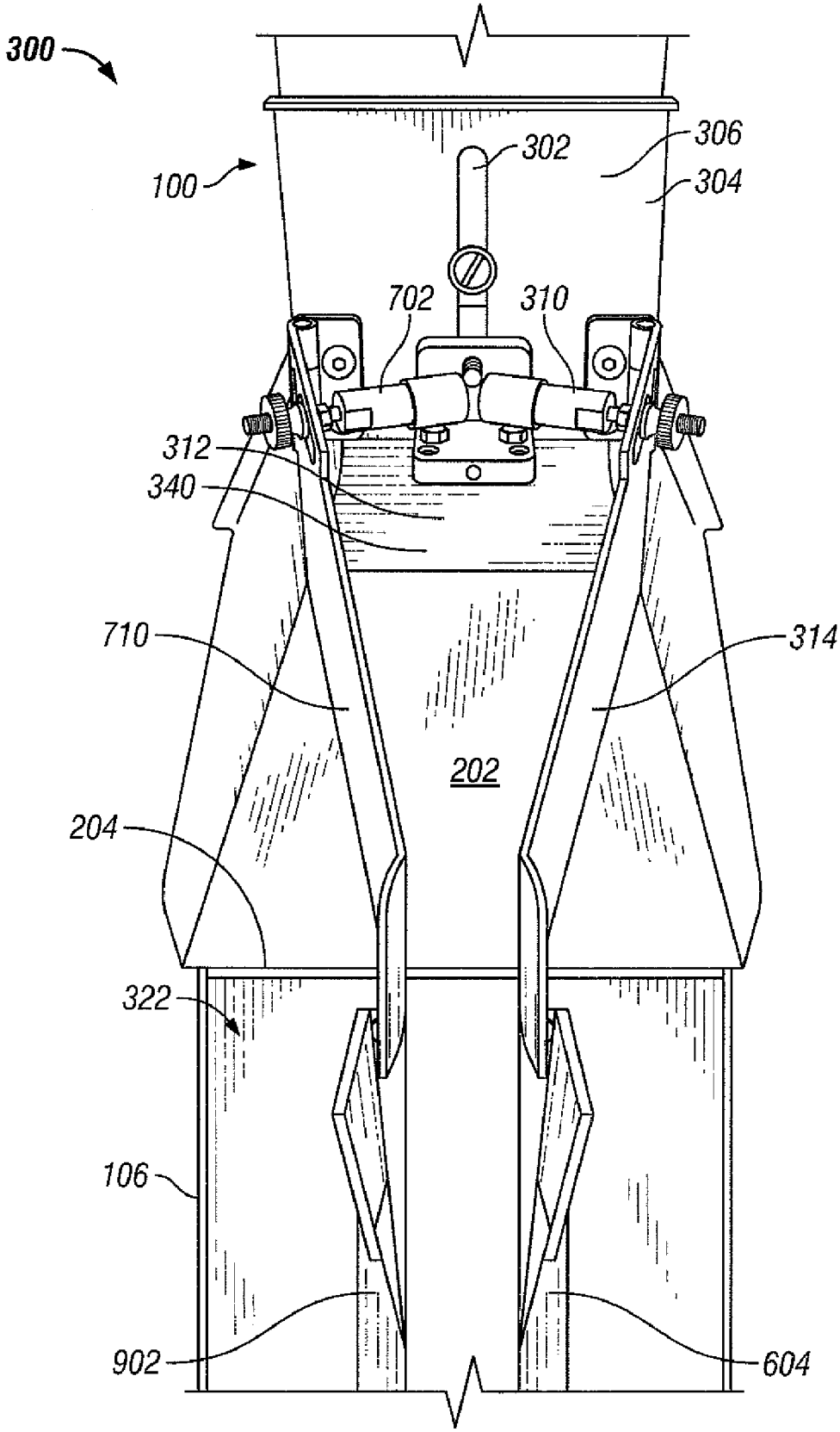
FIG. 9 illustrates a front view of the reduction portion of the present invention with two partitions and adjustment arm assemblies on a single channel slide with the alternative single slide width control guide assembly.
Figure 10:
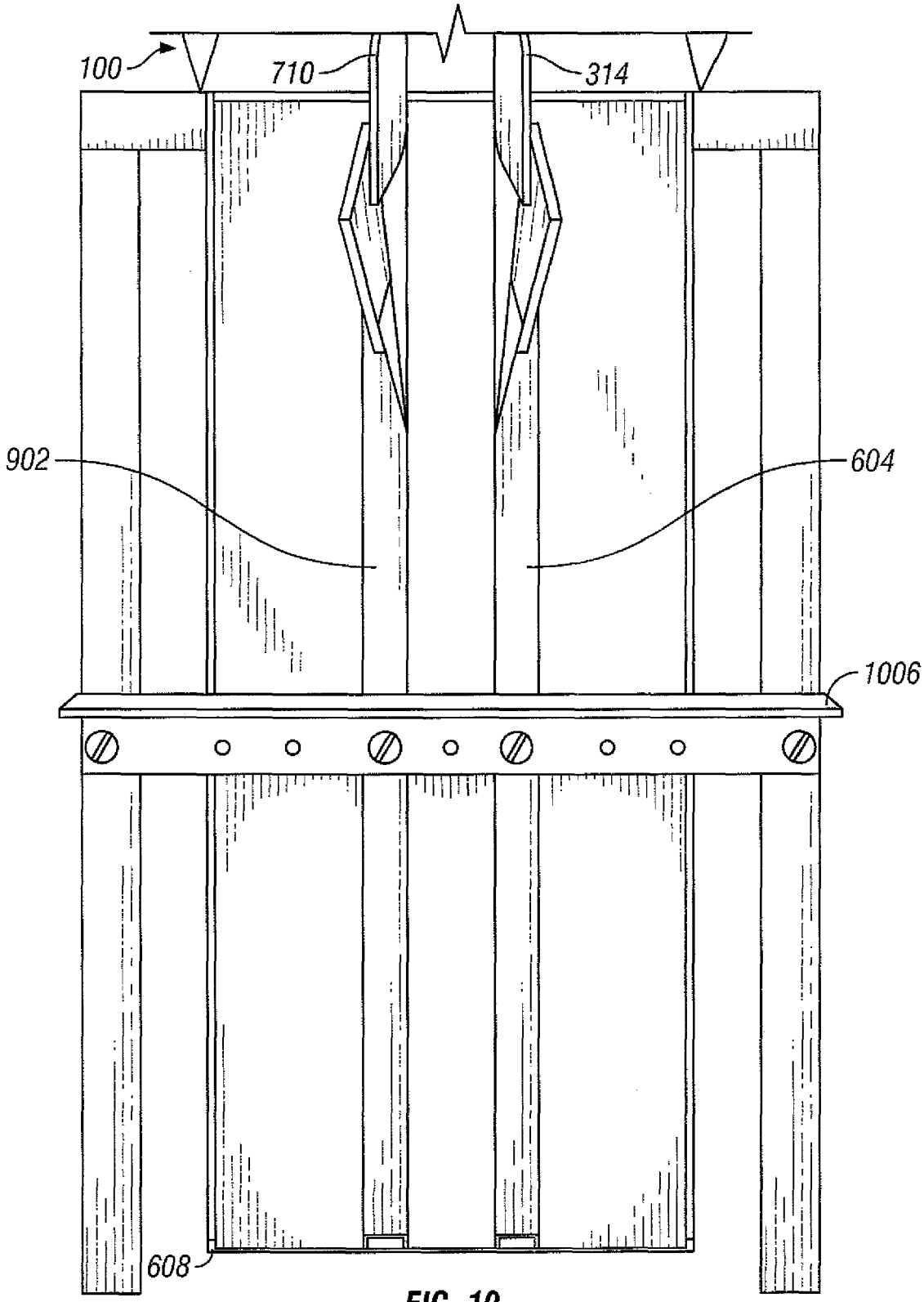
FIG. 10 illustrates a front view of the slide width control portion of the present invention with a dual slide width control guide assembly on a single channel slide with the alternative single slide width control guide assembly.

Referring to FIG. 9 and FIG. 10, the alternative slide width control guide illustrated in FIG. 6 is combined with the dual reduction system illustrated in FIG. 7 and FIG. 8, providing a first slide width control guide 604 and a second slide width control guide 902 and a slide width control guide mounting bracket 1006. The second is a mirror image of the slide width control guide 604 illustrated in FIG. 6.

While several preferred embodiments of the invention have been described and illustrated, it will be understood that the invention is not limited thereto, since many modifications may be made and will become apparent to those skilled in the art. For example, a two-channel slide may have only side supports for a product guide, the divider between the channels being low enough to permit irregular and/or oversized products and foreign objects to overlap into the other channel, as discussed above.

We claim:

1. An adjustable slide width reducer for a gravity slide sorter,
- said gravity slide sorter having an inlet for product and a slide,
  - said product supply inlet having a cross-sectional area,
  - said slide having a direction of travel,
- said adjustable slide width reducer comprising:
- a body,
  - said body for positioning proximate said gravity slide sorter intermediate said product supply inlet and said slide,
- a product flow rate adjustment assembly,
  - said product flow rate adjustment assembly affixed to said body,
  - said product flow rate adjustment assembly for positioning adjacent said product supply inlet,
  - said product flow rate adjustment assembly having an aperture therethrough,
    - said aperture of said product flow rate adjustment assembly for communicating with said product supply inlet,
- a partition,
  - said partition affixed to said body,
  - said partition having a first edge and a second edge,
  - said partition first edge for positioning adjacent said product supply inlet,
  - said partition second edge for positioning adjacent said slide, and
- a slide width control guide,
  - said slide width control guide for contacting said slide,
  - said slide width control guide parallel to said slide direction of travel, and
  - said slide width control guide aligned with said second edge of said partition.

2. The adjustable slide width reducer of claim 1 wherein:
- said aperture of said product flow rate adjustment assembly has a cross-sectional area,
  - said aperture cross-sectional area being adjustable,
- said partition being repositionable, and
- said slide width control guide being repositionable.

3. The adjustable slide width reducer of claim 2 wherein said slide width control guide further comprises:
- an upper body,
  - said upper body having an angled, raised impact surface,
- a top end,
- a retention device sized to the top of said slide,
  - said retention device affixed to said slide width control guide proximate said top end.

4. The adjustable slide width reducer of claim 3 wherein said slide width control guide further comprises:
- a lip sized to overlap a rib of said slide.

5. The adjustable slide width reducer of claim 3 further comprising:
- said product flow rate adjustment assembly repositionable relative to said body,
- said partition being hingedly attached to said body.

6. The adjustable slide width reducer of claim 2 further comprising:
- a slide width control mounting bracket,
  - said slide width control mounting bracket for positioning proximate said slide,
  - said slide width control guide affixed to said slide width control mounting bracket.

7. The adjustable slide width reducer of claim 6 further comprising:
- said product flow rate adjustment assembly repositionable relative to said body,
- said partition being hingedly attached to said body.

8. An adjustable slide width reducer for a gravity slide sorter,
- said gravity slide sorter having an inlet for product and a slide,
  - said product supply inlet having a cross-sectional area,
  - said slide having a direction of travel,
- said adjustable slide width reducer comprising:
- a body,
  - said body for positioning proximate said gravity slide sorter intermediate said product supply inlet and said slide,
- a product flow rate adjustment assembly,
  - said product flow rate adjustment assembly affixed to said body,
  - said product flow rate adjustment assembly for positioning adjacent said product supply inlet,
  - said product flow rate adjustment assembly having an aperture therethrough,
    - said aperture of said product flow rate adjustment assembly for communicating with said product supply inlet,
- two partitions,
  - each said partition affixed to said body,
  - each said partition having a first edge and a second edge,
  - each said partition first edge for positioning adjacent said product supply inlet, each said partition second edge for positioning adjacent said slide, and two slide width control guides, each said slide width control guide for contacting said slide, each said slide width control guide parallel to said slide direction of travel, and each of said slide width control guides aligned with a said second edge of a said partition.

9. The adjustable slide width reducer of claim 8 wherein:

said aperture of said product flow rate adjustment assembly has a cross-sectional area, said aperture cross-sectional area being adjustable, said partition being repositionable, and said slide width control guide being repositionable.

10. The adjustable slide width reducer of claim 9 wherein each said slide width control guide further comprises:

an upper body, said upper body having an angled, raised impact surface, a top end, a retention device sized to the top of said slide, said retention device affixed to said slide width control guide proximate said top end.

11. The adjustable slide width reducer of claim 10 wherein each said slide width control guide further comprises:

a lip sized to overlap a rib of said slide.

12. The adjustable slide width reducer of claim 10 further comprising:

said product flow rate adjustment assembly repositionable relative to said body, each said partition being hingedly attached to said body.

13. The adjustable slide width reducer of claim 9 further comprising:

a slide width control mounting bracket, said slide width control mounting bracket for positioning proximate said slide, each said slide width control guide affixed to said slide width control mounting bracket.

14. The adjustable slide width reducer of claim 13 further comprising:

said product flow rate adjustment assembly repositionable relative to said body, each said partition being hingedly attached to said body.

15. A method of adjusting the slide width of gravity slide sorter, said gravity slide sorter associated with a supply of product to be sorted, said gravity slide sorter having a surface intermediate said supply of product and an inclined slide, said surface having an outflow edge adjacent said inclined slide, said inclined slide having at least one channel, a lower edge, and a surface, the method comprising:

positioning a body proximate said gravity slide sorter, said body having a partition attached thereto, said body having a product flow rate adjustment assembly affixed thereto, said product flow rate adjustment assembly having an aperture therethrough positioning said aperture to control the flow rate of said product through said gravity slide sorter, positioning said partition relative to said surface to provide a desired passageway, said partition having a lower edge adjacent said surface, said partition having a first end extending at least to said outflow edge of said surface, maintaining the position of said partition, positioning a slide width control guide, said slide width control guide aligned with said partition, said slide width control guide parallel to said inclined slide, said slide width control guide having a bottom surface, said slide width control guide bottom surface adjacent said inclined slide surface, and maintaining the position of said slide width control guide.

* * * * *